US009386808B2

(12) United States Patent
Turlan-Van Der Hoeven

(10) Patent No.: US 9,386,808 B2
(45) Date of Patent: Jul. 12, 2016

(54) BRASSIERE, IN PARTICULAR A LACE BRASSIERE, COMPRISING CUPS WITH IMPROVED SUPPORT

(71) Applicant: DBAPPAREL OPERATIONS, Rueil-Malmaison (FR)

(72) Inventor: Manon Turlan-Van Der Hoeven, Marmagne (FR)

(73) Assignee: DBApparel Operations, Rueil-Malmaison (FR)

( * ) Notice: Subject to any disclaimer, the term of this patent is extended or adjusted under 35 U.S.C. 154(b) by 0 days.

(21) Appl. No.: 14/385,442

(22) PCT Filed: Mar. 12, 2013

(86) PCT No.: PCT/FR2013/050520

§ 371 (c)(1),
(2) Date: Sep. 15, 2014

(87) PCT Pub. No.: WO2013/136011

PCT Pub. Date: Sep. 19, 2013

(65) Prior Publication Data

US 2015/0087203 A1 Mar. 26, 2015

(30) Foreign Application Priority Data

Mar. 15, 2012 (FR) ..... 12 52362

(51) Int. Cl.
*A41C 3/10* (2006.01)
*A41C 3/12* (2006.01)
*A41C 3/14* (2006.01)

(52) U.S. Cl.
CPC ... *A41C 3/12* (2013.01); *A41C 3/10* (2013.01); *A41C 3/142* (2013.01)

(58) Field of Classification Search
CPC ..... A41C 1/10–1/20; A41C 3/00; A41C 3/10–3/20
USPC ..... 450/41–53
See application file for complete search history.

(56) References Cited

U.S. PATENT DOCUMENTS 4,080,416 A * 3/1978 Howard ..... A41C 5/005 264/257
6,431,943 B1 * 8/2002 Rehkemper et al. ..... 446/440

(Continued)

FOREIGN PATENT DOCUMENTS

DE 845782 C 8/1952
FR 2924901 A1 6/2009

(Continued)

OTHER PUBLICATIONS

International Search Report issued Oct. 9, 2013 re: PCT/FR2013/050520.

(Continued)

*Primary Examiner* — Gloria Hale
(74) *Attorney, Agent, or Firm* — Fish & Richardson P.C.

(57) ABSTRACT

The invention relates to a brassiere (1) in which each substantially hemispherical cup (2) comprises, in the bottom portion thereof, a polycarbonate support (20) in the shape of a crescent that becomes wider toward the outside, which is thermoformed, and which is secured to the two layers of lace or gauze of the cup by means of a fabric shell adhered to the support and slightly projecting beyond same in order to enable sewing with the layers of lace or gauze along the bottom edge (4). The result is a light brassiere that provides the chest with an advantageous shape.

12 Claims, 3 Drawing Sheets

(56) References Cited

U.S. PATENT DOCUMENTS

| | | | | |
|---|---|---|---|---|
| 6,439,959 | B1 * | 8/2002 | Magrone et al. | 450/41 |
| 6,447,365 | B1 * | 9/2002 | Powell et al. | 450/41 |
| 8,277,276 | B2 * | 10/2012 | Waitz et al. | 450/57 |
| 8,827,765 | B2 * | 9/2014 | Zhang | A41C 3/144 450/39 |
| 8,956,199 | B2 * | 2/2015 | Liu | A41C 3/146 450/38 |
| 2003/0232571 | A1 | 12/2003 | Weinerth | |
| 2007/0087659 | A1 * | 4/2007 | Fildan et al. | 450/41 |
| 2007/0087660 | A1 * | 4/2007 | Fildan et al. | 450/41 |
| 2009/0197509 | A1 | 8/2009 | Fildan et al. | |
| 2009/0233524 | A1 * | 9/2009 | Cohen | A41C 3/0028 450/56 |
| 2010/0015886 | A1 | 1/2010 | Waitz et al. | |
| 2012/0045966 | A1 * | 2/2012 | Zhang | A41C 3/144 450/57 |
| 2013/0165017 | A1 * | 6/2013 | Liu | A41C 3/146 450/38 |

FOREIGN PATENT DOCUMENTS

| | | | |
|---|---|---|---|
| GB | 1210548 | A | 10/1970 |
| GB | 2456897 | A | 8/2009 |
| JP | 2002173806 | | 6/2002 |
| JP | 2003306803 | | 10/2003 |
| JP | 2007303010 | | 11/2007 |

OTHER PUBLICATIONS

Chinese Notification of the First Office Action, CN Application No. 2013800144251, Jul. 13, 2015, 6 pages.

* cited by examiner

Fig.2
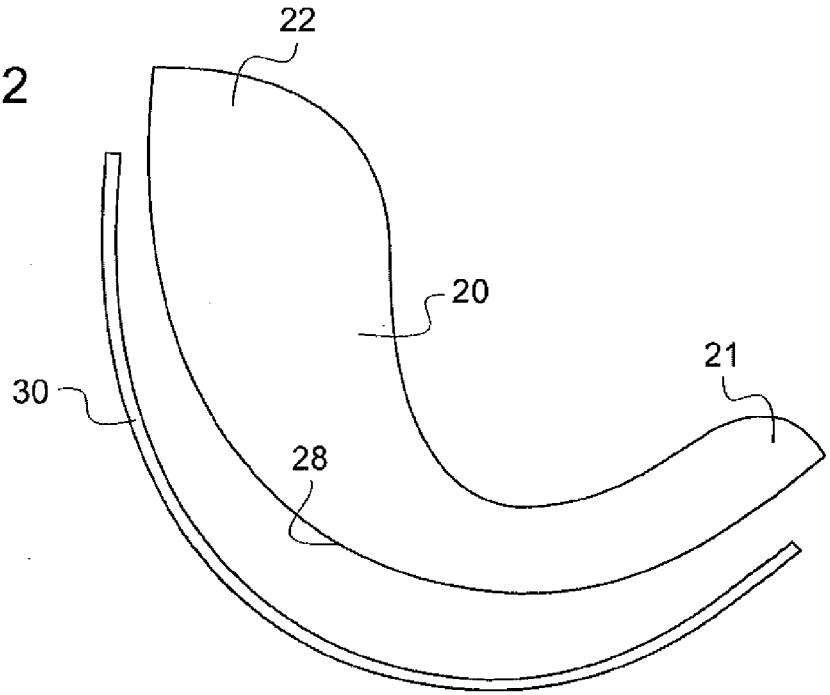
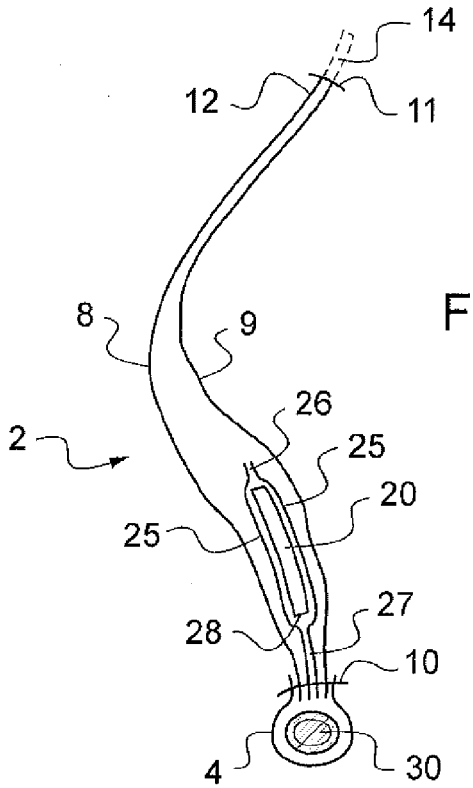
Fig.3

BRASSIERE, IN PARTICULAR A LACE BRASSIERE, COMPRISING CUPS WITH IMPROVED SUPPORT

CROSS-REFERENCE TO RELATED APPLICATIONS

This application is a U.S. National Phase Application under 35 U.S.C. §371 and claims the benefit of priority to International Patent Application Serial No. PCT/FR2013/050520, filed on Mar. 12, 2013, the contents of which are hereby incorporated by reference.

TECHNICAL FIELD

The present invention relates to a brassiere with cups having an improved support.

BACKGROUND

The invention is more particularly focused on brassieres achieved with lightweight materials; in particular textiles materials with holes, such as gauze or lace. It is difficult to give these brassieres a shape that can impart the chest with a nice shape in as far as these materials are particularly light and do not keep their shape. Certainly, it can be provided in these brassieres rigid underwire, often metallic, which is inserted in the brassiere at the lower periphery of the cups of substantially and partially hemispherical shape; however, these rigid underwire create discomfort and marks under the chest for the wearer due to too large difference between the relative hardness of the underwire and the relative softness of the cups made of light textiles; especially these underwire are insufficient for imparting an advantageous shape to the chest, when they are used with lightweight textiles.

Document GB 2456897 makes known in the field of traditional brassieres the placing of an insert intended to replace the underwire. More specifically, this document shows a brassiere comprising, typically, two cups of substantially and partially hemispherical shape each including an external textile layer and an internal textile layer, the two cups being connected to each other on their internal side and being connected on their external side to lateral portions forming a back of the brassiere when they are attached to one another thanks to an attachment device, the top of each cup being connected to a strap fastened to the arm of the brassiere. According to this document, each cup comprises in its lower portion a non-planar insert shaped in space and achieved in a thin sheet of relatively rigid plastic material in a coextensive and elastically flexible direction in a transverse direction, the insert when flat having a substantially circular arc or crescent shape of which the width increases from a first internal end to a second external end, the shaping of the insert shaped in space being adapted so that the insert substantially follows the hemispherical shape of the cup. The insert is shaped by thermoforming, and advantageously secured between the internal and external textile layers of the cup by integral thermofusing during the same operation of thermoforming. It is clear that this embodiment relates to brassieres achieved in textile materials that are rather robust and full, but not in lightweight materials, in particular textile materials with holes, as considered in the present invention.

Document US2003/0232571 makes known a brassiere composed of laminated textile layers in which a polyester reinforcing film is incorporated adhered to at least one of the textile layers, and of which shape is a crescent shape wider towards the outside of the cup than towards the inside. The film has a flat shape by itself; it is not shaped within a three-dimensional shape at rest. Here still, such a brassiere shaped in robust and full textile materials, such as cotton/elastane blends of charmeuse type, but not in lightweight materials such as materials with holes.

BRIEF SUMMARY

The purpose of the invention is to propose a brassiere which allows creating an advantageous shape of the chest, and in particular a bringing together of the breasts (cleavage) even when very lightweight textiles are used for making the cups.

The purpose of the invention is achieved thanks to a brassiere comprising two cups of substantially and partially hemispherical shape each including an external textile layer, an internal textile layer, and in its lower portion a non-planar insert at rest but shaped in space and achieved in a thin sheet of rigid plastic material in a coextensive and elastically flexible direction in a transverse direction, the insert when flat having a substantially circular arc shape of which the width increases from a first internal end to a second external end, the shaping of the insert shaped in space being adapted so that the insert substantially follows the hemispherical shape of the cup, the two cups being connected to each other on their internal side and being connected on their external side to lateral portions forming a back of the brassiere when they are attached to one another thanks to an attachment device, the top of each cup being connected to a strap fastened to the back of the brassiere, characterized in that the insert is disposed between two laminated textile layers, with a marginal projection of the two textile layers at least on its long convex side, the insert being secured to the external and internal textile layers of the brassiere with the marginal projection.

In other words, according to the invention, each brassiere cup includes in its lower portion a flexible support (advantageously in polycarbonate or similar) which is crescent-shaped widening towards the outside and thermoformed to be curved at rest, which is secured to the two layers of lace or gauze advantageously constituting the cup thanks to a fabric shell adhered to the flexible support and marginally projecting to allow sewing with the layers of lace or gauze along the lower edge of the crescent.

It is worth noting that it is known from document US2010/0015886 a mode for fixing a pad which provides a pad shell with a marginal projection secured in the lower portion to the external and internal textile layers of the brassiere; but this technique is used as part of another brassiere family rather than that of the invention, namely the brassiere with pads. The operating of these very soft pads appears to the skilled person as different from that of relatively rigid support plates used according to the invention; the first invokes the notion of comfort more, the second invokes the notion of support more.

For the skilled person, it was not at all obvious or even predictable that it could be used a semi-free fixing device, similar to that described in document US2010/0015886, for attaching the relatively rigid support plate used in the invention and more similar to that of document GB 2 456 897. It could indeed have been of concern that the plate in this state of semi-freedom could no longer ensure the support functions expected of it, or even slide against the breast.

In this, the invention had to overcome a prejudice.

According to the invention, it is provided a marginal projection of a certain importance to allow this securing, for example ranging between 5 mm, or preferably 1 cm, and several centimeters. The securing is advantageously made by sewing with the two internal and external textile layers of the brassiere. This securing is made along an edge of the cup, at its lower portion.

In the case where a metal, plastic or composite, underwire is used, along the lower edge of the cup, the latter is disposed in a braid forming a sheath along said edge and the internal and external textile layers of the cup and the marginal projection are secured at this braid.

In an alternative, the underwire is replaced by a lateral extension of the insert shaped with an angle with respect to the main surface of the sheet constituting the insert. This lateral extension can be fixed in a braid as underwire.

The marginal projection of textile layers covering the insert may serve on the external lateral side of the cup for the assembly with the back portions of the brassiere.

By "rigid material in a coextensive direction to the plate and elastically flexible in a transverse direction" is meant, a material such as that described in document FR 2924901 of the Applicant (a document which nevertheless relates to a very different embodiment in the context of a brassiere constituted of a sandwich of laminated textile layers). It comprises a thin supporting sheet or plate (that is to say, lower than 2 mm and preferably than 1.5 mm of thickness on the most important part of its surface) which due to its constituent matter and its geometry, is rigid and non-deformable in a direction tangent to its surface, but is elastically deformable, in incidentally modest proportions, in a transverse direction. In other words, it is possible to bend a portion of the plate and the latter tends to spontaneously resume its non-deformed position.

A particularly satisfactory material for the achieving of the insert, both from the point of view of its elastic rigidity and its moldability, is polycarbonate, preferably in a thickness of 0.4 to 1.2 mm, for example of 0.5 mm to 1 mm thickness, the thickness able to be chosen larger for large size brassieres than for small size brassieres. In addition, this material is lightweight and can be easily worked (cut out). Among the other materials with similar properties of rigidity/elasticity/thermal molding, it may be cited PET (polyethylene-terephthalate), ABS (acrylonitrile butadiene styrene), PVC (polyvinyl chloride), high impact polystyrene, certain polyethylenes such as high density polyethylene, certain polyamids and certain polypropylenes. It can also comprise composite materials either based of matrices of resins incorporating fibers, or laminations alternating layers of resin and layers of non-woven or woven based fiber of bidirectional or monodirectional type.

As it has been said, the sheet of the insert is disposed between two laminated textile layers, (for example a fabric) with a relatively high marginal projection of the two textile layers on the convex side of the insert and possibly a relatively small marginal projection elsewhere. The two textile layers may advantageously comprise a thin layer of foam laminated on one face of the textile; it is this foam layer that is then laminated with the insert sheet.

The insert is preformed before being integrated to the cup by a thermoforming operation, so that it has at rest, without being worn, a rounded shape in space. Once worn, it may still be deformed in certain directions given its relative elastic flexibility in a direction orthogonal to the surface of the polymer sheet of which it is made.

The insert advantageously receives its coverage of textile/foam during this thermoforming operation.

As indicated above, the textile layers of the brassiere are advantageously lightweight textiles and/or with holes, in particular, lace for the external layer and gauze for the internal portion.

BRIEF DESCRIPTION OF THE DRAWINGS

Other features and advantages of the invention will become apparent from the following description of a particular embodiment example. Reference will be made to the accompanying drawings on which:

FIG. 2 is a top schematic view of an insert (uncoated) in accordance with the invention, flat and associated with an underwire.

FIG. 3 is a schematic sectional view III-III of FIG. 1 showing the various layers of the brassiere cup.

DETAILED DESCRIPTION

Figure 1:
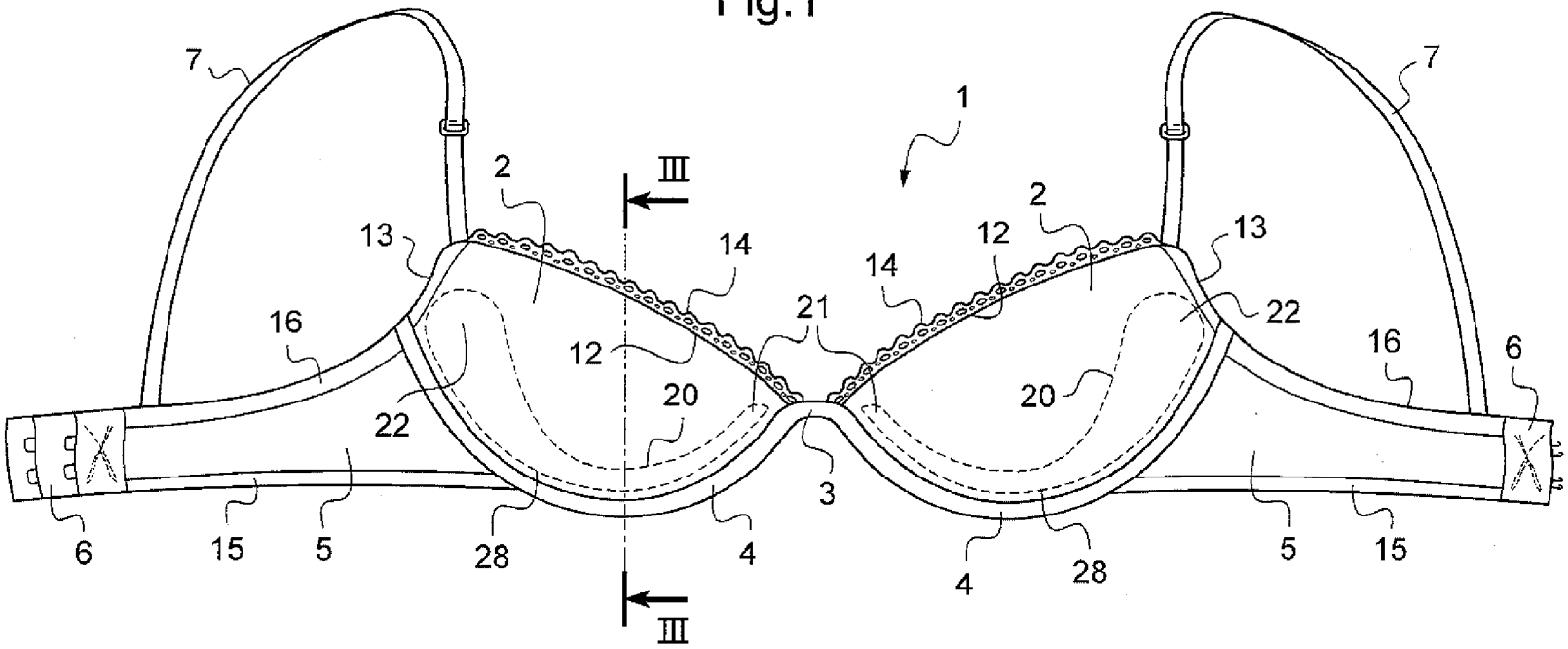
FIG. 1 is a schematic front view of a brassiere in accordance with the invention.

The brassiere 1 of the invention comprises two cups 2 of highly concave shape on the inner side turned towards the skin (substantially and partially hemispherical). The cups 2 are connected together by a short in-between cups 3 portion, which is substantially in the continuity of the lower reinforced convex arched border 4 of each cup 2. The represented brassiere 1 has no basque portion under the cups 2. The arched border 4 laterally rises so that the lateral portion of the cups 2 opposed to the in-between-cups 3 is directly connected to the lateral portions or arm 5 forming the flat portions of the back, which end in attachments 6 allowing to close the back of the brassiere. Straps 7 connect the top of the cups 2, on the external lateral side, to the flat portions of the back 5.

Each cup 2 is constituted (see also FIG. 3) of an external thickness of lightweight textile 8 and of an internal thickness of lightweight textile 9, in particular textile with holes such as light and decorative lace for the external layer 8 and a comfort gauze for the internal layer 9 These two textile layers 8, 9 are attached to one another on their periphery, by a sewing 10 along the lower border 4 by a sewing 11 along the upper border 12 which goes from the in-between cups 3 to the beginning of the strap 7, as well as on the small external lateral border 13 between the beginning of the strap 7 and the external end of the border 4. Preferably, the textile layers 8, 9 are not linked elsewhere than in the periphery, or possibly in a punctual and limited manner. At the upper border 12, the sewing 11 may also fix a lace edge 14 that completes the cup 2 in a decorative manner.

The lower border 4 is enclosed in a folded braid to form a sheath. Similar braids can be provided on the bottom 15 and top 16 edges of the back portions 5, of which the central portion can also be achieved in lightweight textiles, and in particular the same lace as the cups 2. These folded braids allow completing the edges and giving tensile strength to these portions 5.

The small borders 13 can also be finished in the same way by a folded braid. According to the invention each cup 2 incorporates, on its lower circumference, along the border 4, an insert or a support 20 represented in dots on FIG. 1. This insert 20 is a plate cut out from a sheet of polycarbonate of 0.5 mm to 1 mm thickness, of about 15 to 20 cm of length, exhibiting a substantially circular arch or crescent shape going from a first rounded end 21 relatively strait and adjacent to the in-between cups 3, to an opposed end 22 relatively wide and disposed on the side of the beginnings of the back 5 and external border 13. The width of the insert 20 slightly increases or is even constant from the first end 11, where it is for example of 1 to 2 cm, up to an intermediate area located towards the last third of its extension, where the width widens fast enough to open up in a tab at the end 22, for example from 3 to 6 cm wide. This wide tab 22 is intended to be in the cup 2 of the brassiere 1 on the side located near the armpit of the wearer, while the end 21 is on the side of the in-between cups 3.

The plate 20 cut out from the polycarbonate sheet is covered (see FIG. 3) on both faces with a layer of fabric or laminated knit 25 advantageously associated to a layer of laminated elastomeric foam not represented and located on the side of the plate 20. The two fabric layers 25 are provided with a projection of a short marginal edge 26 (of a few millimeters) where the two thicknesses of fabric/foam are adhered to each another directly, over the entire periphery of the plate 20 except for an area of the periphery provided with a greater marginal border 27, for example of several centimeters, intended to secure the insert 20 to the brassiere. This area corresponds for example to the lower convex edge 28 of the plate 20.

The plate 20 is shaped in a thermoforming mold in such a manner as to take the shape it will have in the cup 2, namely a curved shape which could substantially follow the shape of the breast and the shape of the cup 2. This shape is stable, namely that it can under a slight constraint become deformed to take more or less curvature, but the loosening of the constraint allows the support 10 to elastically resume its shape of balance. This step of thermoforming the plate is advantageously used to secure the layers of fabric/foam 25 together and with the plate 20.

Advantageously, by a slight independent thermoforming a hemispherical shape is also given to the two textile layers 8, 9 of the cups 2.

The more significant marginal border 27 is used to secure the coated thermoformed plate 25-20-25 to the textile layers of the brassiere, more particularly at the border 4 in the represented embodiment. This securing is advantageously achieved by sewing, and for example by the same sewing 10 which already brings together the braid constituting the border 4 and the internal 9 and external 8 textile layers of the cup 2. Thus, as is well illustrated in FIG. 3, the plate of the insert 20 is only attached to the textile layers 8, 9 of the cup 2 at its lower convex border; the textile layers 8, 9 are free with respect to the plate 20 for the rest.

It remains to insert an underwire 30 in the form of a metal arch or elastic rigid composite in the sheath formed by the braid sewn at the border 4 to complete the tailoring of the brassiere 1.

This brassiere 1 while maintaining the general appearance of lightness and refinement provided by the use of light textiles and in particular lace, allows however to act on the breasts in order to support them thanks to the insert 20 and bring them closer together so as to form a cleavage which is satisfactory.

It has been represented on FIG. 2 the bare insert 20 (not coated with its laminated textile shell) next to the underwire 30 near which it is found in the brassiere and to which it is linked through the marginal projection portion 27 and the braid of the border 4.

Figure 4:
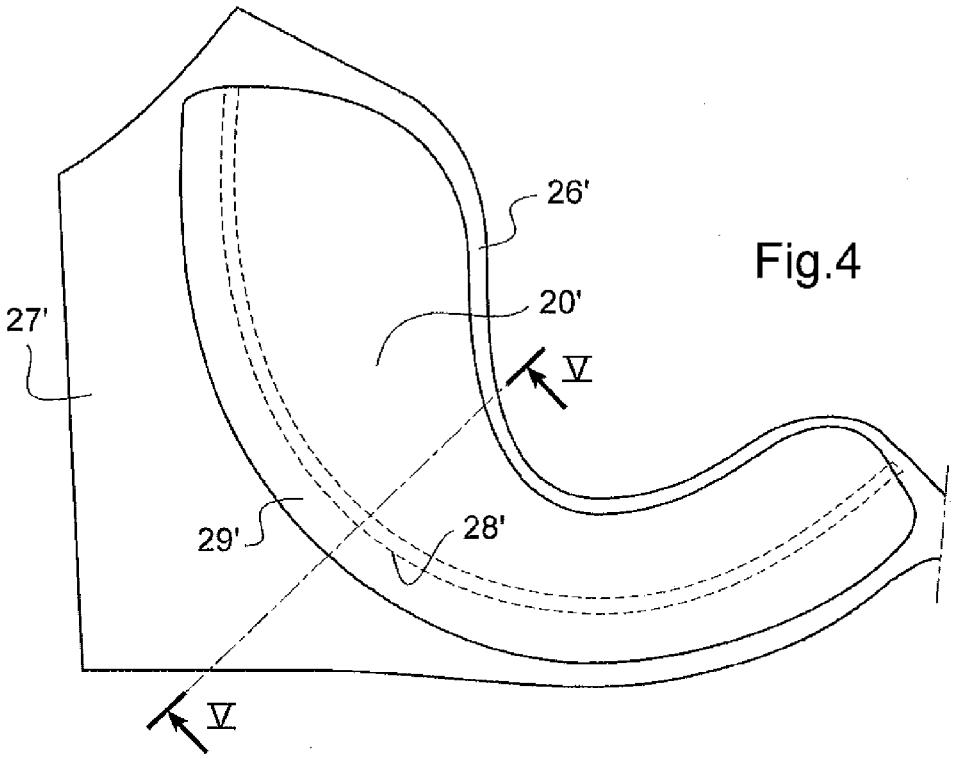
FIG. 4 is a schematic top view of an alternative flat insert (coated) in accordance with the invention.
Figure 5:
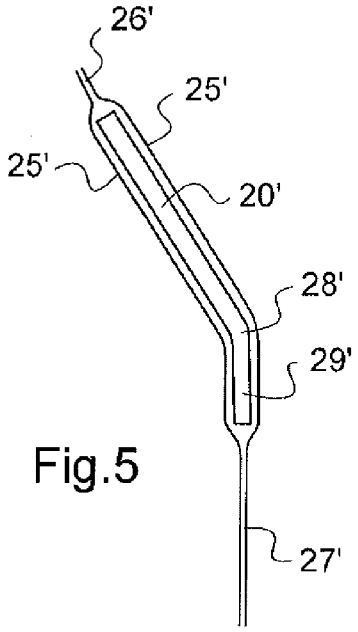
FIG. 5 is a sectional schematic view V-V of FIG. 4 showing the bent shape of the insert.

It has been represented on FIGS. 4 and 5 an alternative in which the underwire 30 is not used but replaced by an angular shaping given to an extension/widening of the insert 20' beyond the convex line 28' corresponding to the convex edge 28 of the first embodiment. A convex widening portion 29' indeed extends the insert laterally, and this portion 29' is bent with respect to the main surface of the insert during the thermoforming as can be seen on FIG. 5. As in the previous embodiment, it is taken advantage of the thermoforming to give an overall cambered shape to the insert 20', and to coat it with layers of fabric/foam which marginally project to form a narrow border 26' and a wide border 27' intended for securing to the elements constituting the brassiere. Particularly in the example represented on FIG. 4, a rather significant marginal portion 27' is provided on the external side of the insert 20' to serve for the connection with the back portions of the brassiere.

The invention claimed is:

1. A brassiere comprising:

two cups of substantially hemispherical shape, each cup including an external textile layer, an internal textile layer, and in a lower portion of each cup between the external layer and the internal layer and apart from a bottom periphery of each cup, a non-planar insert at rest but shaped in space, the insert comprising a sheet of plastic material that is rigid in a coextensive direction and elastically flexible in a transverse direction, a front profile of the insert having a substantially circular arc shape of which a width of the insert increases from a first internal end to a second external end of the insert, the shaping of the insert shaped in space being adapted so that the insert substantially follows the hemispherical shape of the cup;

wherein the two cups are connected together on their internal sides and are connected on their external sides to lateral portions forming a back of the brassiere when they are attached to one another with an attachment device;

wherein the top of each cup is connected to a strap fastened to the back of the brassiere;

wherein the insert of each cup is disposed between two laminated textile layers, the two laminated textile layers comprising a marginal projection that extends at least from a long convex side of the insert to the bottom periphery of the cup, the marginal projection being secured to the brassiere at the bottom periphery of the cup; and wherein the two laminated textile layers surrounding the insert are free from attachments to the brassiere other than the marginal projection being secured at the bottom periphery of the cup such that the insert is disposed in a semi-free state between the external and internal textile layers at the lower portion of the cup of the brassiere.

2. The brassiere according to claim 1, wherein the marginal projection ranges between 5 mm and about 5 centimeters.

3. The brassiere according to 1, wherein the securing is done by sewing with the two internal and external textile layers of the brassiere.

4. The brassiere according to 1, wherein the securing is made along an edge of the cup, in a lower portion.

5. The brassiere according to claim 1, wherein an underwire is disposed along the lower edge of the cup, in a braid forming a sheath along said edge and the internal and external textile layers and the marginal projection are secured at this braid.

6. The brassiere according to claim 1, wherein the brassiere does not have an underwire and the insert comprises a lateral extension shaped with an angle with respect to the main surface of the sheet constituting the insert.

7. The brassiere according to claim 1, wherein the marginal projection of the textile layers covering the insert serves on the external lateral side of the cup for the assembly with the back portions of the brassiere.

8. The brassiere according to 1, wherein the insert is a polycarbonate having a thickness of 0.4 to 1.2 mm.

9. The brassiere according to claim 1, wherein the insert is coated with layers of foam and laminated textile.

10. The brassiere according to claim 1, wherein the textile layers of the brassiere are lightweight textiles and/or with holes comprising lace for the external layer and gauze for the internal portion.

11. The brassiere according to claim 1, wherein the insert comprises an intermediate area between the first internal end and the second external end of the insert, the intermediate area located along a length of the insert about a third of the length of the insert from the first internal end, wherein the width of the insert is substantially constant between the first internal end and the intermediate area, and increases from the intermediate area to the second external end.

12. A brassiere comprising:

two cups of substantially hemispherical shape, each cup including an external textile layer, an internal textile layer, and in a lower portion of each cup between the external layer and the internal layer and apart from a bottom periphery of each cup, a non-planar insert at rest but shaped in space, the insert comprising a sheet of plastic material that is rigid in a coextensive direction and elastically flexible in a transverse direction, a front profile of the insert having a substantially circular arc shape of which a width of the insert increases from a first internal end to a second external end of the insert, the shaping of the insert shaped in space being adapted so that the insert substantially follows the hemispherical shape of the cup;

wherein the insert of each cup is disposed between two laminated textile layers, the two laminated textile layers comprising a marginal projection that extends at least from a long convex side of the insert to the bottom periphery of the cup, the marginal projection being secured to the brassiere at the bottom periphery of the cup; and wherein the two laminated textile layers surrounding the insert are free from attachments to the brassiere other than the marginal projection being secured at the bottom periphery of the cup such that the insert is disposed in a semi-free state between the external and internal textile layers at the lower portion of the cup of the brassiere.

* * * * *